US009545130B2

(12) United States Patent
Polegato Moretti

(10) Patent No.: US 9,545,130 B2
(45) Date of Patent: Jan. 17, 2017

(54) WATERPROOF AND VAPOR-PERMEABLE SHOE

(75) Inventor: Mario Polegato Moretti, Crocetta del Montello (IT)

(73) Assignee: GEOX S.p.A., Montebelluna (IT)

( * ) Notice: Subject to any disclaimer, the term of this patent is extended or adjusted under 35 U.S.C. 154(b) by 60 days.

(21) Appl. No.: 13/263,822

(22) PCT Filed: Mar. 12, 2010

(86) PCT No.: PCT/EP2010/053220

§ 371 (c)(1),
(2), (4) Date: Oct. 10, 2011

(87) PCT Pub. No.: WO2010/115678

PCT Pub. Date: Oct. 14, 2010

(65) Prior Publication Data

US 2012/0055042 A1 Mar. 8, 2012

(30) Foreign Application Priority Data

Apr. 10, 2009 (EP) ..... 09425137

(51) Int. Cl.
*A43B 13/00* (2006.01)
*A43B 7/06* (2006.01)
(Continued)

(52) U.S. Cl.
CPC ..... *A43B 7/125* (2013.01); *A43B 7/08* (2013.01); *A43B 7/087* (2013.01)

(58) Field of Classification Search
CPC ..... A43B 7/08; A43B 4/125; A43B 4/087
(Continued)

(56) References Cited

U.S. PATENT DOCUMENTS 5,285,546 A * 2/1994 Haimerl ..... 12/142 E
5,426,869 A * 6/1995 Gore et al. ..... 36/22 R
(Continued)

FOREIGN PATENT DOCUMENTS

EP 0 713 657 5/1996
JP 60-140406 9/1985
(Continued)

OTHER PUBLICATIONS

Combined Georgian Office Action and Search Report issued Jul. 11, 2013 in Patent Application No. AP 2010 012443 with English Translation.

(Continued)

*Primary Examiner* — Jila M Mohandesi
*Assistant Examiner* — Katharine Gracz
(74) *Attorney, Agent, or Firm* — Oblon, McClelland, Maier & Neustadt, L.L.P.

(57) ABSTRACT

A waterproof and vapor-permeable shoe, comprising a sole, provided with a vapor permeation region, an assembly insole, which is covered, toward the sole, by at least one first gasket made of waterproof material, which has at least one vapor-permeable or perforated portion above the vapor permeation region, which, once assembled, covers an upper shoe assembly, which comprises at least one vapor-permeable lining, a vapor-permeable upper, and a waterproof and vapor-permeable upper membrane that is between them, the upper shoe assembly being associated with the assembly insole, and at least one second gasket, which adheres so to form a waterproof seal to the first gasket and is glued to the lower edge of the upper, the second gasket forming a waterproof sealing region of the upper shoe assembly and the first gasket to the sole.

15 Claims, 7 Drawing Sheets

(51) Int. Cl.
*A43B 7/12* (2006.01)
*A43B 7/08* (2006.01)

(58) Field of Classification Search
USPC .. 36/3 B, 3 R, 30 R, 25 R, 31, 14; 12/146 B, 12/142 R, 146 BR, 142 RS, 142 T
See application file for complete search history.

(56) References Cited

U.S. PATENT DOCUMENTS

| | | | | |
|---|---|---|---|---|
| 5,983,524 | A * | 11/1999 | Polegato | 36/3 R |
| 8,281,502 | B2 * | 10/2012 | Haimerl | 36/14 |
| 8,566,991 | B2 * | 10/2013 | Mueller | 12/146 B |
| 2002/0040537 | A1 * | 4/2002 | Polegato Moretti | 36/14 |
| 2002/0053148 | A1 * | 5/2002 | Haimerl | 36/55 |
| 2006/0162183 | A1 * | 7/2006 | Polegato Moretti | 36/3 B |
| 2007/0011907 | A1 * | 1/2007 | Polegato Moretti | A43B 3/128 36/3 B |
| 2008/0216358 | A1 | 9/2008 | Polegato Moretti | |
| 2009/0188134 | A1 | 7/2009 | Polegato Moretti | |
| 2010/0050480 | A1 | 3/2010 | Polegato Moretti | |
| 2010/0115792 | A1 | 5/2010 | Muller | |
| 2011/0252667 | A1 | 10/2011 | Polegato Moretti | |

FOREIGN PATENT DOCUMENTS

| | | |
|---|---|---|
| JP | 11-513582 | 11/1999 |
| JP | 2000-152807 | 6/2000 |
| JP | 2009-502272 | 1/2009 |
| WO | WO 03/070041 A1 | 8/2003 |
| WO | 2007 012415 | 2/2007 |
| WO | 2008 116772 | 10/2008 |
| WO | 2008 119683 | 10/2008 |

OTHER PUBLICATIONS

International Search Report Issued Jul. 2, 2010 in PCT/EP10/053220 filed Mar. 12, 2010.
European Search Report Issued Sep. 21, 2009 in European Patent Application No. 09425137 filed Apr. 10, 2009.
U.S. Appl. No. 13/611,536, filed Sep. 12, 2012, Polegato Moretti.
U.S. Appl. No. 13/393,090, filed Feb. 28, 2012, Polegato Moretti.
Office Action issued Jan. 28, 2014 in Japanese Application No. 2012-503942 (With English Translation).

* cited by examiner

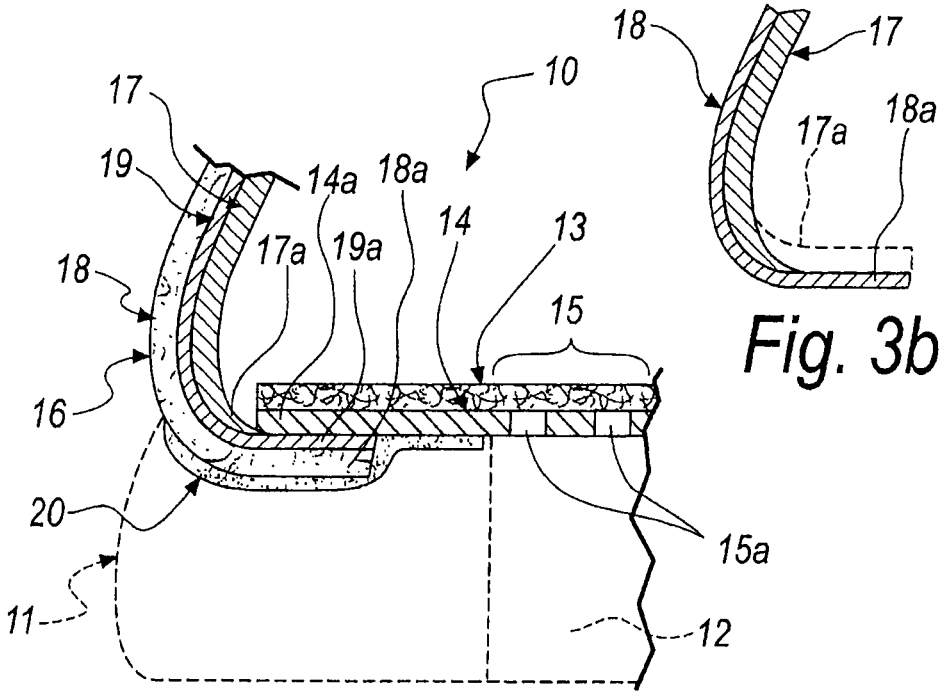
Fig. 3b
Fig. 3a
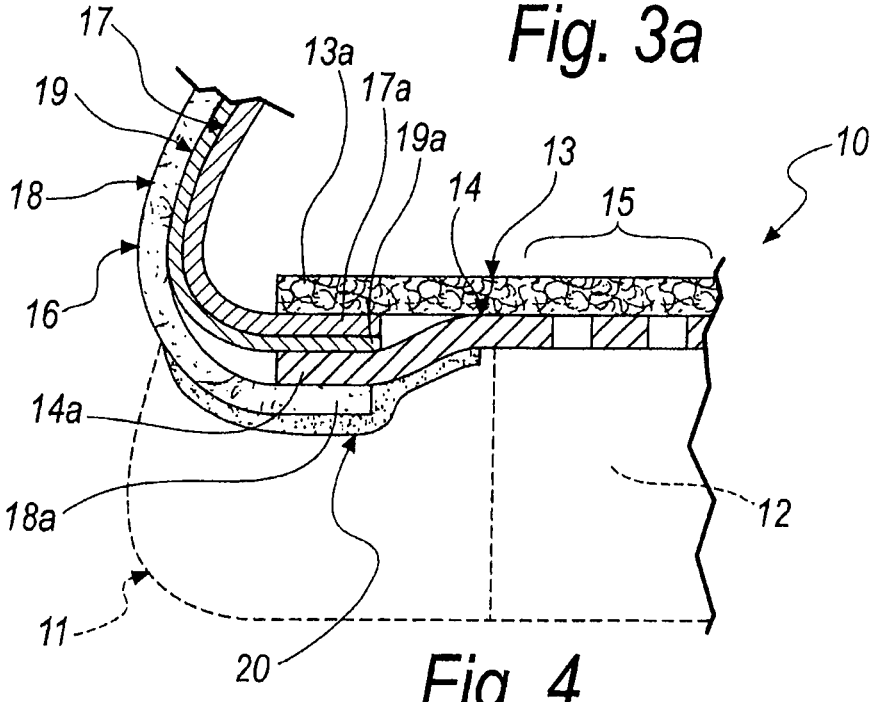
Fig. 4

WATERPROOF AND VAPOR-PERMEABLE SHOE

TECHNICAL FIELD

The present invention relates to a waterproof and vapor-permeable shoe, predominantly manufactured by means of the working method known as "AGO lasting".

BACKGROUND ART

It is known that the comfort of a shoe is linked not only to its anatomically fitting properties but also to the capacity to dissipate outward the water vapor that forms inside the shoe due to sweating.

For this reason, waterproof shoes with an upper coupled to a lining that is laminated with a waterproof and vapor-permeable membrane have now been known for years.

The expression "waterproof and vapor-permeable" generally references the characteristic of tightness to water in the liquid state combined with permeability to water vapor.

The portion of the foot that notoriously has the greatest perspiration effect is the sole, and the sweat that it generates saturates the air with moisture and mostly condenses, stagnating on the footbed.

Only a marginal fraction of the moisture produced by sweating is diffused to the sides of the upper and exits from them if they are vapor-permeable.

In order to allow easy dissipation of the sweat that tends to accumulate in the region of the sole, shoes are currently known which have different types of rubber soles that are impermeable to water in the liquid state and are permeable to water vapor and are obtained by using a vapor-permeable and waterproof membrane, which is sealed to the body of the sole so as to cover through openings thereof.

The production method commonly known as "AGO lasting" has long been known in the shoe manufacturing field and provides, with an operation known as lasting, for pulling the upper shoe assembly onto the last, folding its lower edges, known as lasting margins, under an insole, to which they are glued perimetrically, so as to interpose themselves partially between said insole and the sole that will be assembled thereon.

Assembling the sole consists in joining the sole to the upper portion of the shoe, by gluing or by direct injection in a mold.

So-called "AGO lasting" construction is generally used for shoes of the type generally classified as classic or elegant.

Stretching the upper and the lining on the last in fact allows to make them adhere thereto precisely, achieving effective formation.

The assembly insole is made of a flexible material that however is structured enough to not undergo deformation due to the traction applied thereto by the lasting margins glued onto it during lasting.

Currently it is known that even when the upper shoe assembly has a waterproof and vapor-permeable membrane, inserted between the outer layer of the upper and the inner lining without additional refinements, then there is a substantially total lack of waterproofing.

The "AGO lasting" construction, in the way it is currently performed, in fact allows penetration of water toward the inside of the shoe through the outer layer of the upper and through the insole.

A need that is particularly felt in the manufacture of shoes with a waterproof and vapor-permeable membrane, in the upper shoe assembly, consists in achieving an effective seal of the joining regions between the insole, the lining with membrane, the outer layer of the upper and sole, in order to avoid even the slightest infiltration of water from outside.

It is in fact particularly difficult to seal the sole to said membrane, since in so-called "AGO lasting" construction the bottom of the shoe is not smooth and flat, as occurs for example in the case of "Strobel" construction, in which the edges of the insole are sewn to the edges of the upper or of the lining laminated with the membrane, but the lasting margins of the upper are superimposed on the assembly insole, creating irregularities along its perimeter.

In particular, the creases produced as a consequence of the assembly of the toe and heel of the upper onto the assembly insole constitute actual channels for water infiltration.

However, it is not possible to remove these protrusions by means of the common operation of roughing the upper with steel brushes, since this operation might damage the waterproof and vapor-permeable membrane inserted between the upper and the lining.

Accordingly, as described for example in patent application WO 9316612, shoes have now been studied for years which have a waterproof and vapor-permeable insole which comprises a waterproof and vapor-permeable membrane with which the lasting margins of a lining with a waterproof and vapor-permeable membrane are associated by means of a first lasting operation.

The joining region between the lining with the membrane and the insole is sealed by means of a waterproof sealing tape.

The lasting margins of the outer layer of the upper are then associated, by means of a second lasting operation, with the waterproof and vapor-permeable insole.

The embodiment is not free from aspects that can be improved, since the water absorbed by the outer layer of the upper and wicked inside it can stagnate below the waterproof insole.

Moreover, this construction has an additional drawback if a sole provided with openings is used, since water might enter through said openings and wet the lasting margins of the upper, impregnating it and thus rising toward the foot insertion region.

Moreover, the use of a waterproof and vapor-permeable membrane that covers the entire surface of the insole, if the vapor-permeable surface of the sole does not extend over its entire longitudinal direction, is useless and very expensive.

An alternative to the use of a waterproof and vapor-permeable insole is described in U.S. Pat. No. 5,426,869, in which a waterproof layer acting as a gasket is provided by a non-woven polyester fabric that is uniformly coated on one of its faces with a layer of adhesive based on polycaprolactone. This waterproof gasket is used to fill the area comprised transversely between the lasting margins of the lining or upper, if they are waterproof and vapor-permeable, and constitutes a waterproof layer between the insole and the sole.

Since the gasket is made of waterproof and non-vapor-permeable material, this construction is unsuitable with a rubber sole rendered impermeable to water in the liquid state and permeable to water vapor by means of regions that are open or perforated and are covered and sealed with a waterproof and vapor-permeable membrane.

Moreover, if the gasket is pierced at the vapor-permeable area of the sole, in order to allow the outflow of the water vapor generated by sweating, the lasting margins of the outer layer of the upper would wick, toward the inside of the shoe, the water, which would migrate onto the insole indeed through the holes in the gasket.

An alternative to these solutions is to use a lining with a waterproof and vapor-permeable membrane that is closed like a sock, so as to wrap around the foot completely.

An insole is applied to the bottom of the sock and the lasting margins of the outer layer of the upper are folded and glued onto it perimetrically.

The sock-like lining comprises an opening for the foot and is generally formed by two lateral portions and a lower portion, the connection of which is provided by means of zigzag and/or Strobel seams and sealed by means of waterproof sealant tape.

It is well-known that this production method is very complicated and delicate.

Moreover, precise shaping of the sock closed by means of seams and not by lasting on a last is difficult to achieve, both due to difficulty in preparing the various components that must be cut and sewn with accurate precision and due to difficulty in achieving correct tension, without creases, between the upper and the lining.

Indeed, due to the fact that during the sewing of the lining the last is not used, said lining tends to wrinkle during the lasting of the upper, contrary to what instead occurs when one uses "AGO lasting" construction, which allows to obtain an upper and a lining that are correctly formed, stretched and smooth.

DISCLOSURE OF THE INVENTION

The aim of the present invention is to provide a waterproof and vapor-permeable shoe that allows to prevent the infiltration of water between the assembly insole and the sole, being structurally simpler than currently known waterproof and vapor-permeable shoes.

Within this aim, an object of the invention is to propose a waterproof and vapor-permeable shoe that is provided predominantly according to the method known as "AGO lasting" and has an effective and durable seal of the top waterproof and vapor-permeable assembly with respect to the sole.

Another object of the invention is to provide a waterproof and vapor-permeable shoe that is effectively and durably waterproof, being at the same time effectively vapor-permeable through its upper and through its sole, having a waterproof seal that is simple and easy to provide.

Another object of the invention is to propose a waterproof and vapor-permeable shoe that is structurally simple and comfortable to use and can be manufactured with relatively low costs.

This aim, as well as these and other objects that will become better apparent hereinafter, are achieved by a waterproof and vapor-permeable shoe, characterized in that it comprises:

- a sole, provided with a vapor permeation region;
- an assembly insole, which is covered, toward the sole, by at least one first gasket made of waterproof material, which has at least one vapor-permeable or perforated portion above said vapor permeation region, which, once assembled, covers
- an upper shoe assembly, which comprises at least one vapor-permeable lining, a vapor-permeable upper, and a waterproof and vapor-permeable upper membrane that is between them, said upper shoe assembly being associated with said assembly insole at least predominantly according to the construction known as "AGO lasting",
- at least one second gasket, made of waterproof material, which adheres so to form a waterproof seal to said first gasket and is glued to the lower edge of said upper, which it surmounts, said second gasket forming a waterproof sealing region of said upper shoe assembly and said first gasket to said sole, leaving free for vapor permeation at least said vapor-permeable or perforated portion.

BRIEF DESCRIPTION OF THE DRAWINGS

Further characteristics and advantages of the invention will become better apparent from the description of preferred but exclusive embodiments of the vapor-permeable and waterproof shoe according to the invention, illustrated by way of non-limiting example in the accompanying drawings, wherein:

FIGS. 1, 2, 3*a*, 4, 5, 6, 7 and 9 are sectional detail views of a simplified diagram of a detail of a waterproof and vapor-permeable shoe provided in various embodiments, according to the invention;

FIG. 3*b* is a separate sectional detail view of a component, visible in FIG. 3*a*, of a waterproof and vapor-permeable shoe, according to the invention;

Figure 1:
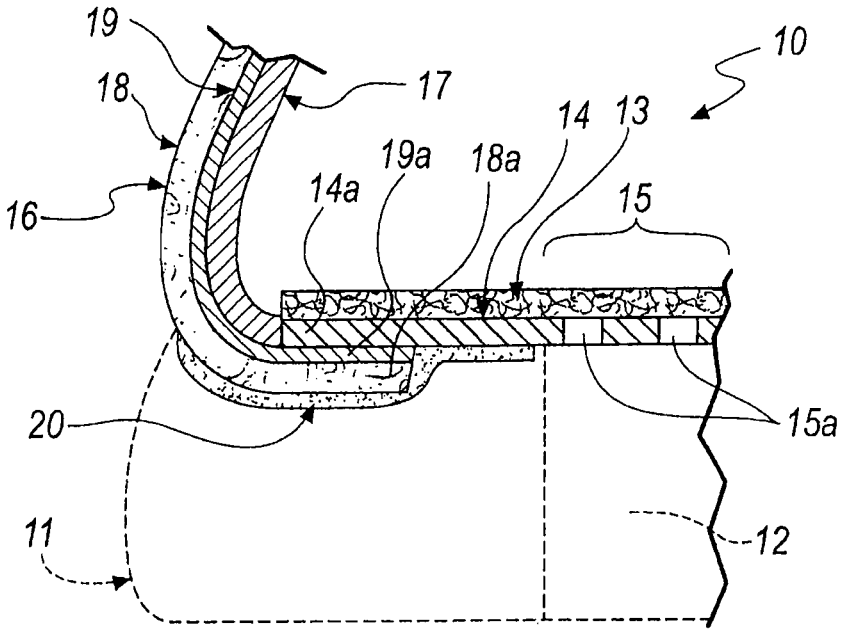

It is noted that anything found to be already known during the patenting process is understood not to be claimed and to be the subject of a disclaimer.

WAYS of Carrying Out the Invention

With reference to the cited figures, the reference numeral 10 generally designate a waterproof and vapor-permeable shoe, which has a particularity in that it comprises:

- a sole 11, which has a vapor permeation region 12,
- an assembly insole 13, which is covered, toward the sole 11, by at least one first gasket 14 made of waterproof material, which has at least one vapor-permeable or perforated portion 15 above the vapor permeation region 12, which, when assembled, it covers,
- an upper shoe assembly 16, which at least comprises a vapor-permeable lining 17, a vapor-permeable upper 18, and a waterproof and vapor-permeable upper membrane 19, which is between them, the upper shoe assembly 16 being associated with the assembly insole 13, at least predominantly according to the construction known as "AGO lasting",
- at least one second gasket 20, made of waterproof material, which adheres so as to provide a waterproof seal to the first gasket 14 and is glued to the lower edge 18*a* of the upper 18 that it surmounts, the second gasket 20 forming a region for the waterproof sealing of the upper shoe assembly 16 and of the first gasket 14 to the sole 11, leaving free for vapor permeation at least the vapor-permeable or perforated portion 15.

Advantageously,

- the upper 18 is made of leather or vapor-permeable fabric, and
- the upper membrane 19 is of the type of commonly commercially available vapor-permeable and waterproof membranes, for example made of expanded polytetrafluoroethylene, also known as e-PTFE, polyurethane, also known as PU, or the like, and a mesh that reinforces it is conveniently associated therewith.

In order to further strengthen the lower rim 19*a* of the upper membrane 19, it can be advantageous to apply, directly on the lower rim 19*a*, a waterproof reinforcement element, not shown in the figures, for example a thermo-adhesive tape, which is preferably elastic and is made of synthetic material, such as for example polyurethane.

One tape that is particularly suitable for providing said waterproof reinforcement element is proposed commercially by the company TecnoGI with a weight of 120-250 g/m$^2$.

Moreover, the assembly insole 13 is conveniently reinforced in the plantar arch and in the heel with a shank made of leather, plastic material or metal for greater support and torsion resistance of the shoe.

The second gasket 20 conveniently adheres hermetically to the first gasket 14 along a band that is approximately 5 mm wide, perimetrically with respect to the vapor-permeable or perforated portion 15.

In general, it should be noted that it is important that the second gasket 20 does not extend so as to cover the vapor-permeable or perforated portion 15 of the first gasket 14 or the vapor permeation region 12 of the sole 11, or that it is perforated at said vapor permeation region 12, in order to not compromise the vapor permeability, through the sole 11, of the waterproof and vapor-permeable shoe 10.

For this reason, the border of the vapor permeation region 12 of the sole 11 is conveniently internal with respect to the inner perimeter of the second gasket 20.

The second gasket 20 advantageously is a film of thermoplastic hot-melt adhesive made of polyurethane, polyester, polyamide or polyolefin that can be activated by means of heat and pressure.

Said film, heated and pressed, softens and penetrates within the permeable substrates to be sealed, onto which it is pressed.

By cooling it then establishes a connection, by adhesive bonding, of the mechanical and chemical type, with these substrates and reacquires its original strength.

One film that is particularly suitable for providing the second gasket 20 is proposed commercially by the company Bemis Associates Inc. with product code 3218, or by the company Collano AG, XIRO Adhesive Films, with product code XAF 36.004 (Puro).

The useful waterproof area for sealing the sole 11 to the upper shoe assembly 16 and to the first gasket 14 is constituted:

- by the waterproof region of the first gasket 14, which is left free by the lasting margins of the upper shoe assembly 16 and is external to the vapor-permeable or perforated portion 15, and
- by the portion of the second gasket 20 that covers the lower edge 18*a* of the upper 18.

Said waterproof area useful for sealing the sole 11 and the upper shoe assembly 16 is extended perimetrically so as to surround the vapor permeation region 12 of the sole 11 and the vapor-permeable or perforated portion 15 of the first gasket 14.

The second gasket 20 conveniently extends the waterproof sealing area of the upper shoe assembly 16 to the sole 11 also to the upper 18 and stops infiltrations of any water absorbed by the material of the upper 18.

In this manner it is possible to avoid stagnation of water between the assembly insole 13 and the sole 11 and its wicking within the shoe from the part of the vapor-permeable or perforated portion 15 of the first gasket 14.

If the vapor permeation region 12 extends over the entire longitudinal extension of the sole 11, then the vapor-permeable or perforated portion 15 of the first gasket 14 preferably extends along the entire surface of the assembly insole 13.

In alternative variations, not shown in the accompanying figures, the vapor-permeable or perforated portion 15 is advantageously formed by one or more localized regions of the first gasket 14, if the vapor permeation region 12 affects corresponding localized regions of the sole 11.

In a first embodiment of a waterproof and vapor-permeable shoe 10, according to the invention, advantageously the lower rim 19*a* of the upper membrane 19 and the lower edge 18*a* of the upper 18 are joined quite coincident and are folded and glued hermetically, at least predominantly according to the construction known as "AGO lasting", below the perimetric edge 14*a* of the first gasket 14, without using nails or staples for fixing, which would compromise the waterproofness of the upper membrane 19.

The second gasket 20 surmounts and straddles the lower edge 18*a* and the first gasket 14, sealing them impermeably to each other and to the sole 11.

In this embodiment, the upper membrane 19 is coupled to the upper 18, for example by means of spots of thermo-adhesive glue so as to not compromise its vapor permeability.

Advantageously, the first gasket 14 is made of waterproof polymeric material, the vapor permeable or perforated portion 15 having a plurality of holes 15*a* that pass through its thickness.

At the same time, the sole 11 has one or more broad openings or a plurality of holes 12*a* that face the vapor-permeable or perforated portion 15 and are covered hermetically by a waterproof and vapor-permeable insert 21 to allow the evacuation of vapor from the foot insertion region A, simultaneously preventing the rise of liquid toward it.

The waterproof polymeric material of which the first gasket 14 is made is conveniently polyurethane, PU, or polyethylene, PE, or polyvinyl chloride, PVC, or thermoplastic film.

Conveniently, the first gasket 14 is joined by gluing directly to the lower face of the assembly insole 13 prior to the construction of the upper shoe assembly 16.

Conveniently, the lasting margin composed of the lower edge 18*a* and the lower rim 19*a* joined together protrudes from the lower flap 17*a* of the lining 17 by approximately 10-15 mm.

The lasting of said lasting margin, which consists in turning over and gluing hermetically, below the perimetric edge 14*a* of the first gasket 14, the lower edge 18*a* and the lower rim 19*a* joined together, according to the construction known as "AGO lasting", is performed conveniently with a machine known as "lasting machine", in which the lasting pincers, however, have been flattened, i.e., have been deprived of their clamping teeth or millings, so as to not tear the upper membrane 19.

The hermetic joining between the upper membrane 19 of the upper shoe assembly 16 and the first gasket 14 occurs conveniently by using ordinary adhesive used in lasting operations, such as adhesive of the thermoplastic, polyurethane or neoprene type, or any other equivalent capable of ensuring an effective seal.

The waterproof and vapor-permeable shoe 10 conveniently is obtained by joining

- the sole 11, by adhesive bonding or overmolding,
- to an upper assembly, obtained by associating with the upper shoe assembly 16 the assembly insole 13, with "AGO lasting" construction, by means of the first gasket 14 and the second gasket 20.

The sole 11 is sealed impermeably to the upper shoe assembly 16 at the second gasket 20.

Figure 2:
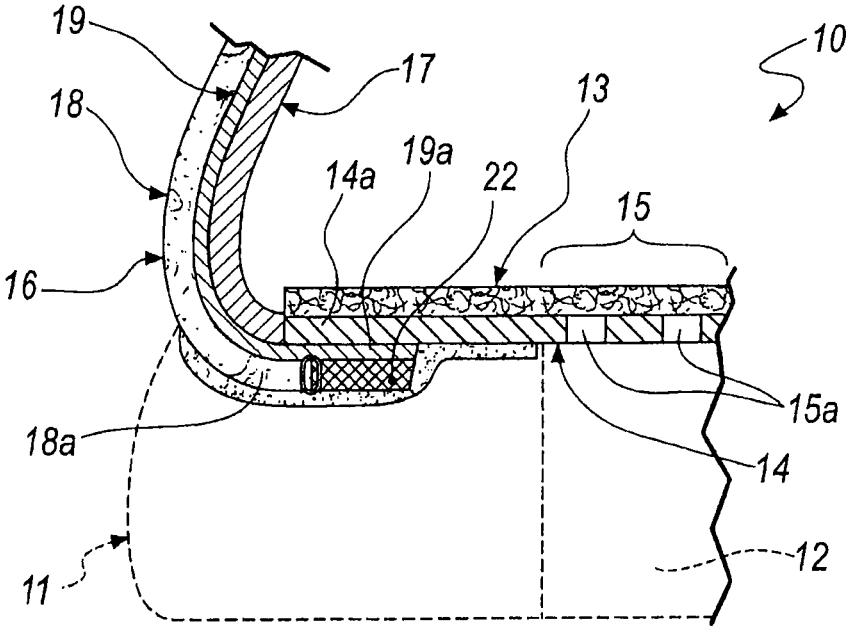

With particular reference to FIG. 2, in a variation of said first embodiment of a waterproof and vapor-permeable shoe 10, the lower edge 18*a* is advantageously provided with a sealing element 22, which is joined quite coincident with the lower rim 19*a* of the upper membrane 19.

The lower rim 19*a* and the sealing element 22 are conveniently folded and glued hermetically, according to the construction known as "AGO lasting", below the perimetric edge 14*a* of the first gasket 14, the second gasket 20 surmounting and straddling the sealing element 22 and the first gasket 14, sealing them impermeably to each other and to the sole 11.

Conveniently, the sealing element 22 extends from the lower edge 18*a* of the upper 18, to which it is joined by means of a zigzag seam, by approximately 8-12 mm.

During the assembly of the waterproof and vapor-permeable shoe 10, the upper membrane 19 is associated with the upper 18 after its joining to the sealing element 22, so as to waterproof its connection region.

Preferably, the sealing element 22 is thinner than the upper 18 and is made of a lighter material than the upper 18, so as to limit the formation of creases created as a consequence of the operation for assembling the toe and heel of the upper 18 on the first gasket 14.

In a first embodiment of the sealing element 22, it is advantageously made of waterproof and heat-activatable polymeric material, which adheres intimately so as to form a seal to the lower rim 19*a* and to the second gasket 20, mutually sealing them.

In particular, the sealing element 22 is made of thermo-adhesive waterproof material, such as a thermoplastic hot-melt adhesive tape capable of melting and sealing itself to the upper membrane 19.

In a second and alternative embodiment of the sealing element 22, in a substantially equivalent manner it is permeable to sealing material.

The material that constitutes the second gasket 20 permeates the sealing element 22 so as to grip, forming a waterproof seal, the lower rim 19*a*, sealing it impermeably to the first gasket 14.

Conveniently, in this second embodiment, the sealing element 22 is made of a mesh of synthetic material, knitted fabric, woven fabric or three-dimensional fabric, by means of which it is possible to pass sealing materials or the polymeric material that composes the sole 11.

Preferably, the sealing element 22 is constituted by a monofilament material, so as to not wick water.

Thus, the second gasket 20 seals directly to the upper membrane 19, passing through the sealing element 22 or fusing with it.

Moreover, the gluing margin of the upper 18, being provided by the sealing element 22, is thin with respect to the upper 18 and does not require roughing, since the upper is substantially proximate to the bottom edge of the last.

The second gasket 20 extends the waterproof sealing area of the upper shoe assembly 16 to the sole 11 also onto the sealing element 22 and stops infiltrations of any water absorbed by the material of the upper 18.

Another function of the sealing element 22 is to strengthen the lower rim 19*a* of the upper membrane 19, while allowing its sealing to the second gasket 20.

As an alternative, if the lasting operation is performed manually, by using appropriate pincers, then advantageously it is possible to not use said sealing element 22, without the danger of damaging the lower rim 19*a* of the upper membrane 19 during lasting.

Thus, the second gasket 20 adheres hermetically directly to the upper membrane 19.

In this manner, it is possible to avoid the stagnation of water between the assembly insole 13 and the sole 11 and its wicking within the shoe 10 on the side of the vapor-permeable or perforated portion 15 of the first gasket 14.

In order to facilitate the waterproof sealing of the upper membrane 19 to the first gasket 14, the lasting margin of the upper shoe assembly 16, formed by joining the lower edge 18*a* to the lower rim 19*a*, advantageously protrudes with respect to the lower flap 17*a* of the lining 17 by approximately 10-15 mm.

The hermetic joining between said lasting margin and the first gasket 14 occurs conveniently by using ordinary adhesive used in lasting operations, such as adhesive of the thermoplastic or polyurethane type or of the type of synthetic rubbers based on polychloroprene, commonly known under the commercial name Neoprene, or any other equivalent capable of ensuring an effective seal.

With particular reference to FIGS. 3*a* and 3*b*, in a second embodiment of a waterproof and vapor-permeable shoe 10, according to the invention, advantageously the lower flap 17*a* of the lining 17 and the lower rim 19*a* of the upper membrane 19 are joined conveniently quite coincident, the lower flap 17*a* being skived so as to expose the lower rim 19*a*, which by being exposed through the lower flap 17*a* is folded over and glued hermetically, at least predominantly according to the construction known as "AGO lasting", below the perimetric edge 14*a* of the first gasket 14.

More particularly, in said second embodiment the upper membrane 19, optionally associated with a mesh, is laminated with the lining 17.

Conveniently, the first gasket 14 is joined by adhesive bonding directly to the lower face of the assembly insole 13 prior to the construction of the upper shoe assembly 16.

If the vapor permeation region 12 extends along the entire longitudinal extension of the sole 11, then the vapor-permeable or perforated portion 15 of the first gasket 14 preferably extends along the entire surface of the assembly insole 13.

In alternative variations, not shown in the accompanying figures, the vapor-permeable or perforated portion 15 is advantageously formed by one or more localized regions of the first gasket 14, if the vapor permeation region 12 affects corresponding localized regions of the sole 11.

In order to facilitate the waterproof sealing of the upper membrane 19 to the first gasket 14, the lower flap 17*a* of the lining 17 advantageously is skived so as to expose the lower rim 19*a* of the upper membrane 19 for approximately 10-15 mm without damaging it.

This skiving operation consists in reducing the thickness of the margin of the material that constitutes the lower flap 17*a*, performed for example with a tool known as skiving machine, for example of the type known commercially as "Fortuna 4".

During skiving, it can be difficult to skive the lining 17 until the lower lip 19*a* of the upper membrane 19 is exposed effectively without damaging it; it is therefore advantageous to impregnate with adhesive the lower flap 17*a* that has been skived, so that it reaches, by gripping it, the lower rim 19*a*, before the lasting operation, in such a manner as to reinforce the tightness of the waterproof seal between the lower rim 19*a* and the first gasket 14.

The operation for lasting said lasting margin, which consists in folding and gluing hermetically, below the lower perimetric edge 14*a* of the first gasket 14, the lower rim 19*a* joined to the skived lower flap 17*a*, according to the construction known as "AGO lasting", is conveniently performed with a machine known as "lasting machine", in which the lasting pincers have been flattened, i.e., have been deprived of their fastening teeth or millings, so as to not tear the upper membrane 19.

The sealing coupling between the upper membrane 19 of the upper shoe assembly 16 and the first gasket 14 occurs conveniently by using ordinary adhesive used in lasting operations, such as adhesive of the thermoplastic, polyurethane or neoprene type, or any other equivalent type capable of ensuring an effective seal.

As an alternative, the lasting operation can occur manually by using appropriate pincers.

The upper 18 is assembled over the lower rim 19*a* of the upper membrane 19, with a second lasting operation, by using for gluing an adhesive of the type commonly used in currently known lasting procedures.

As an alternative, the lasting of the waterproof and vapor-permeable shoe 10, in said second embodiment, provides for the assembly, below the perimetric edge 14*a* of the first gasket 14, of the lasting margins of the upper shoe assembly 16, which are constituted by the joining of the lower edge 18*a* of the upper 18 to the lower rim 19 joined to the skived lower flap 17*a*.

The second gasket 20 surmounts and straddles the lower edge 18*a* and the first gasket 14, sealing them impermeably to each other and to the sole 11.

Advantageously, the first gasket 14 is made of waterproof polymeric material, the vapor-permeable or perforated portion 15 having a plurality of holes 15*a* that pass through its thickness.

At the same time, the sole 11 has one or more broad openings or a plurality of holes 12*a* that face the vapor-permeable or perforated portion 15 and are covered hermetically by a waterproof and vapor-permeable insert 21, in order to allow the evacuation of vapor from the foot insertion region A, simultaneously preventing the rise of liquid toward it.

The waterproof polymeric material of which the first gasket 14 is made is conveniently polyurethane (PU) or polyethylene (PE) or polyvinyl chloride (PVC) or thermoplastic film.

With particular reference to FIG. 4, in a third embodiment of a waterproof and vapor-permeable shoe 10, according to the invention, advantageously the lower flap 17*a* of the lining 17 and the lower rim 19*a* of the upper membrane 19 are conveniently joined quite coincident, folded and glued, at least predominantly according to the construction known as "AGO lasting", below the perimetric region 13*a* of the assembly insole 13.

In an alternative variation, not show in the accompanying figures, advantageously the lower flap 17*a* of the lining 17 and the lower rim 19*a* of the upper membrane 19 are joined quite coincident and are sewn, preferably according to the construction known as "Strobel", to the perimetric region 13*a* of the assembly insole 13.

The perimetric edge 14*a* of the first gasket 14 conveniently surmounts and straddles the assembly insole 13 and the lower rim 19*a* and seals itself impermeably thereto.

The lower edge 18*a* of the upper 18 is conveniently folded and glued, according to the construction known as "AGO lasting", below the perimetric edge 14*a* of the first gasket 14, the second gasket 20 straddling and surmounting the lower edge 18*a* and the first gasket 14, sealing them impermeably to each other and to the sole 11.

In this third embodiment of the invention, the upper membrane 19 advantageously is laminated with the lining 17.

The operation for lasting below the assembly insole 13 the lasting margins of the upper shoe assembly 16, constituted by the lower flap 17*a* joined to the lower rim 19*a*, is performed conveniently with a machine known as lasting machine, in which the lasting pincers have been flattened, i.e., have no clamping teeth or millings so as to not tear the upper membrane 19.

The gluing of the lower flap 17*a* to the assembly insole 13 occurs conveniently by using an adhesive that is commonly used in currently known lasting operations.

As an alternative, the lasting operation can occur manually by using appropriately provided pincers.

The hermetic joining between the lower rim 19*a* of the upper membrane 19 and the first gasket 14 conveniently is provided by means of an adhesive of the polyurethane type commonly used in operations for cementing currently known soles.

The upper 18, therefore, is lasted above the first gasket 14, with a second lasting operation, for which an adhesive commonly used for lasting is employed conveniently.

Advantageously, the first gasket 14 is made of waterproof polymeric material, the vapor-permeable or perforated portion 15 having a plurality of holes 15*a* that pass through its thickness.

At the same time, the sole 11 has one or more broad openings or a plurality of holes 12*a* that face the vapor-permeable or perforated portion 15 and are covered hermetically by a waterproof and vapor-permeable insert 21, to allow the evacuation of vapor from the foot insertion region A, simultaneously preventing the rise of liquid toward said region.

The waterproof polymeric material of which the first gasket 14 is made is conveniently polyurethane (PU) or polyethylene (PE), or polyvinyl chloride (PVC) or thermoplastic film.

Figure 5:
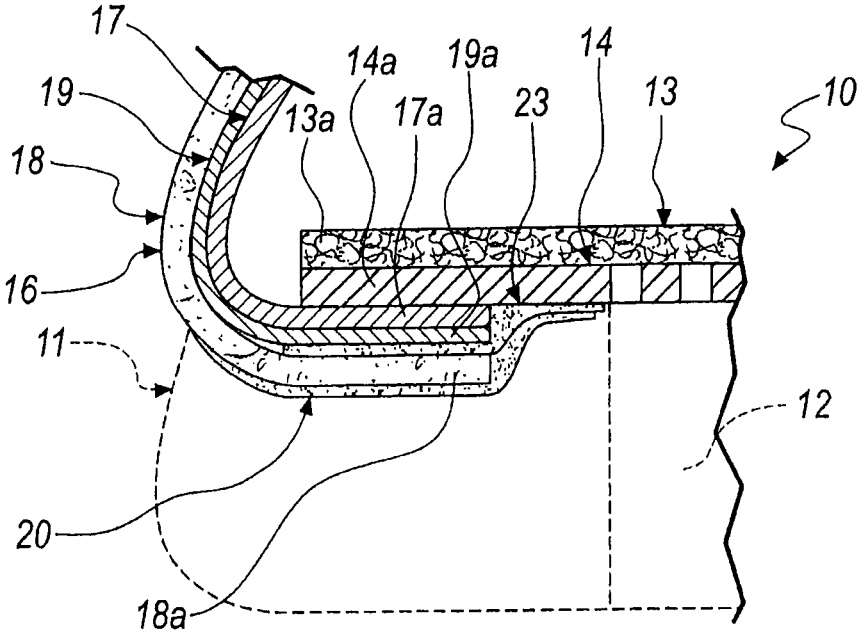

With reference to FIG. 5, in a fourth embodiment of a waterproof and vapor-permeable shoe 10, according to the invention, advantageously the lower flap 17*a* of the lining 17 and the lower rim 19*a* of the upper to membrane 19 are joined conveniently quite coincident, folded and glued, at least predominantly according to the construction known as "AGO lasting", below the perimetric edge 14*a* of the first gasket 14.

In an alternative variation, not shown in the accompanying figures, advantageously the lower flap 17*a* of the lining 17 and the lower rim 19*a* of is the upper membrane 19 are joined quite coincident and are sewn, preferably according to the construction known as "Strobel", to the perimetric region 13*a* and to the perimetric edge 14*a* respectively of the assembly insole 13 and of the first gasket 14.

An auxiliary gasket 23 advantageously surmounts and straddles the first gasket 14 and the lower rim 19*a*, sealing them impermeably to each other.

The lower edge 18*a* of the upper 18 is folded and glued, according to the construction known as "AGO lasting", on the auxiliary gasket 23, the second gasket 20 surmounting and straddling the lower edge 18*a* and the auxiliary gasket 23, sealing them impermeably to each other and to the sole 11.

In this fourth embodiment of the invention also, the upper membrane 19 is advantageously laminated to the lining 17.

The operation for lasting the lasting margins of the upper shoe assembly 16 constituted by the lower flap 17*a* of the lining 17, joined to the lower rim 19*a*, of the upper membrane 19, below the first gasket 14, is performed conveniently with a machine known as "lasting machine", in which the lasting pincers have been flattened or have no clamping teeth or millings, so as to not tear the upper membrane 19.

The gluing of the lower flap 17*a* to the first gasket 14 occurs conveniently by using an adhesive that is commonly used in currently known lasting operations.

As an alternative, the lasting operation can occur manually by using appropriate pincers.

Conveniently, the auxiliary gasket 23, by sealing the lower rim 19*a* to the first gasket 14, extends thereon by approximately 5 mm.

Moreover, the auxiliary gasket 23 advantageously is a film of thermoplastic hot-melt adhesive made of polyurethane, polyester, polyamide or polyolefins, which can be activated by means of heat and pressure.

A film that is particularly adapted for providing the second gasket 20 and the auxiliary gasket 23 is proposed commercially by the company Bemis Associates Inc with product code 3218, or by the company Collano AG Xiro Adhesive Films with product code XAF 36.004 (Puro).

The second gasket 20, by sealing the lower edge 18*a* to the first gasket 14, surmounting the auxiliary gasket 23, conveniently extends thereon by approximately 5 mm.

Advantageously, the first gasket 14 is made of waterproof polymeric material, the vapor-permeable or perforated portion 15 having a plurality of holes 15*a* that pass through its thickness.

Simultaneously, the sole 11 has one or more broad openings or a plurality of holes 12*a* that face the vapor-permeable or perforated portion 15 and are covered hermetically by a waterproof and vapor-permeable insert 21 to allow the evacuation of vapor from the foot insertion region A, at the same time preventing the rise of liquid toward said region.

The waterproof polymeric material of which the first gasket 14 is made is conveniently polyurethane (PU) or polyethylene (PE) or polyvinyl chloride (PVC) or thermoplastic film.

Conveniently, the first gasket 14 is joined by adhesive bonding directly to the lower face of the assembly insole 13, before the construction of the upper shoe assembly 16.

Figure 6:
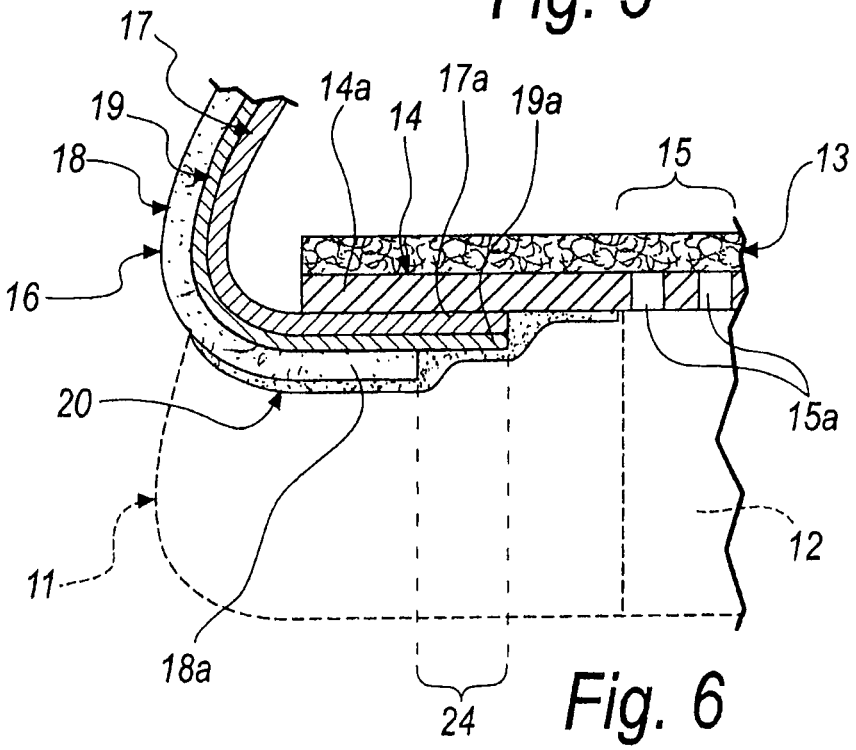

With reference to FIG. 6, in a fifth embodiment of a waterproof and vapor-permeable shoe 10, according to the invention, advantageously the lower flap 17*a* of the lining 17 and the lower rim 19*a* of the upper membrane 19 are joined conveniently quite coincident, folded and glued, at least predominantly according to the construction known as "AGO lasting", below the perimetric edge 14*a* of the first gasket 14, without using fixing staples or nails, which would compromise the impermeability of the upper membrane 19.

The lower edge 18*a* of the upper 18 is conveniently folded and glued, is according to the construction known as "AGO lasting", on the lower rim 19*a*, leaving exposed an end portion 24 thereof which advantageously extends for approximately 10 mm.

The second gasket 20 conveniently surmounts and straddles the lower edge 18*a*, the end portion 24 and the first gasket 14, sealing them impermeably to each other and to the sole 11.

The operation for lasting the lasting margins of the upper shoe assembly 16 constituted by the lower flap 17*a*, the lining 17, joined to the lower rim 19*a*, of the upper membrane 19, below the first gasket 14, is performed conveniently with a machine known as "lasting machine", in which the lasting pincers have been flattened or lack clamping teeth or millings so as to not tear the upper membrane 19.

The gluing of the lower flap 17*a* to the first gasket 14 occurs conveniently by using an adhesive that is commonly used in currently known lasting operations.

As an alternative, said lasting operation can occur manually by using appropriate pincers.

The second gasket 20, by sealing the lower edge 18*a* to the first gasket 14, conveniently extends onto it for approximately 5 mm.

Advantageously, the first gasket 14 is made of waterproof polymeric material, the vapor-permeable or perforated portion 15 having a plurality of holes 15*a* that pass through its thickness.

At the same time, the sole 11 has one or more broad openings or a plurality of holes 12*a* that face the vapor-permeable or perforated portion 15 and are covered so as to provide a seal by a waterproof and vapor-permeable insert 21, in order to allow the evacuation of vapor from the foot insertion region A, simultaneously preventing the rise of liquid toward said region.

The waterproof polymeric material of which the first gasket 14 is made is conveniently polyurethane (PU) or polyethylene (PE) or polyvinyl chloride (PVC) or thermoplastic film.

Conveniently, the first gasket 14 is joined by gluing directly to the lower face of the assembly insole 13, before the construction of the upper shoe assembly 16.

Figure 7:
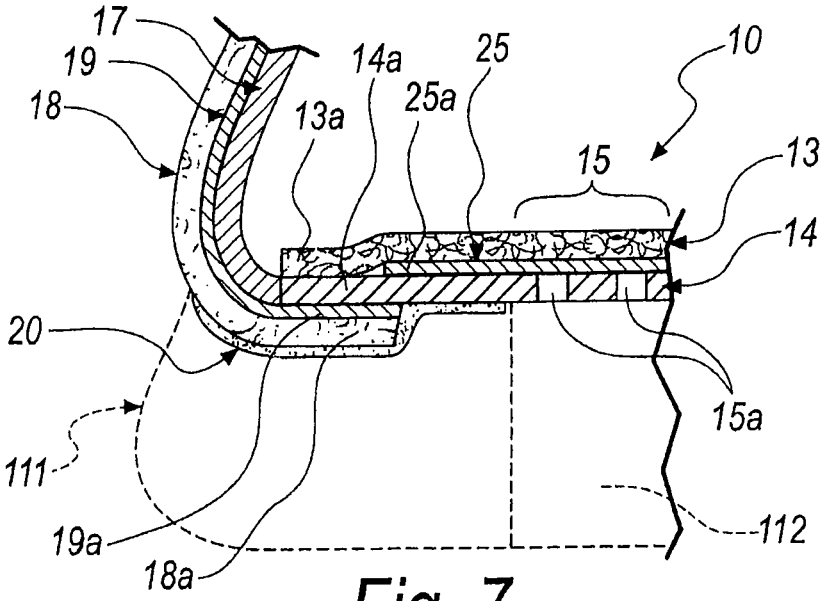

With reference to FIG. 7, in a sixth embodiment of a waterproof and vapor-permeable shoe 10, according to the invention, said shoe advantageously comprises a waterproof and vapor-permeable plantar insert 25, which is between the assembly insole 13 and the first gasket 14 at least at the vapor-permeable or perforated portion 15.

The plantar insert is advantageously sealed to the first gasket 14 along its perimeter 25*a* so as to cover at least the vapor-permeable or perforated portion 15, sealing it impermeably.

Moreover, the vapor-permeable or perforated portion 15 is sealed perimetrically by means of the second gasket 20 to a sole 111, so as to cover its vapor permeation region 112, which has one or more broad openings or a plurality of free holes 112*a* that pass through its thickness for the evacuation of the water vapor that arrives from the foot insertion region A.

The first gasket 14 is conveniently made of waterproof polymeric material, the vapor-permeable or perforated portion 15 having a plurality of holes 15*a* that pass through its thickness and are covered so as to provide a seal by the plantar insert 25.

Advantageously, the plantar insert 25 comprises at least one membrane made of expanded polytetrafluoroethylene, also known as e-PTFE, or polyurethane, also known as PU, or similar materials, and optionally is associated on its faces with one or two meshes.

Figure 8:
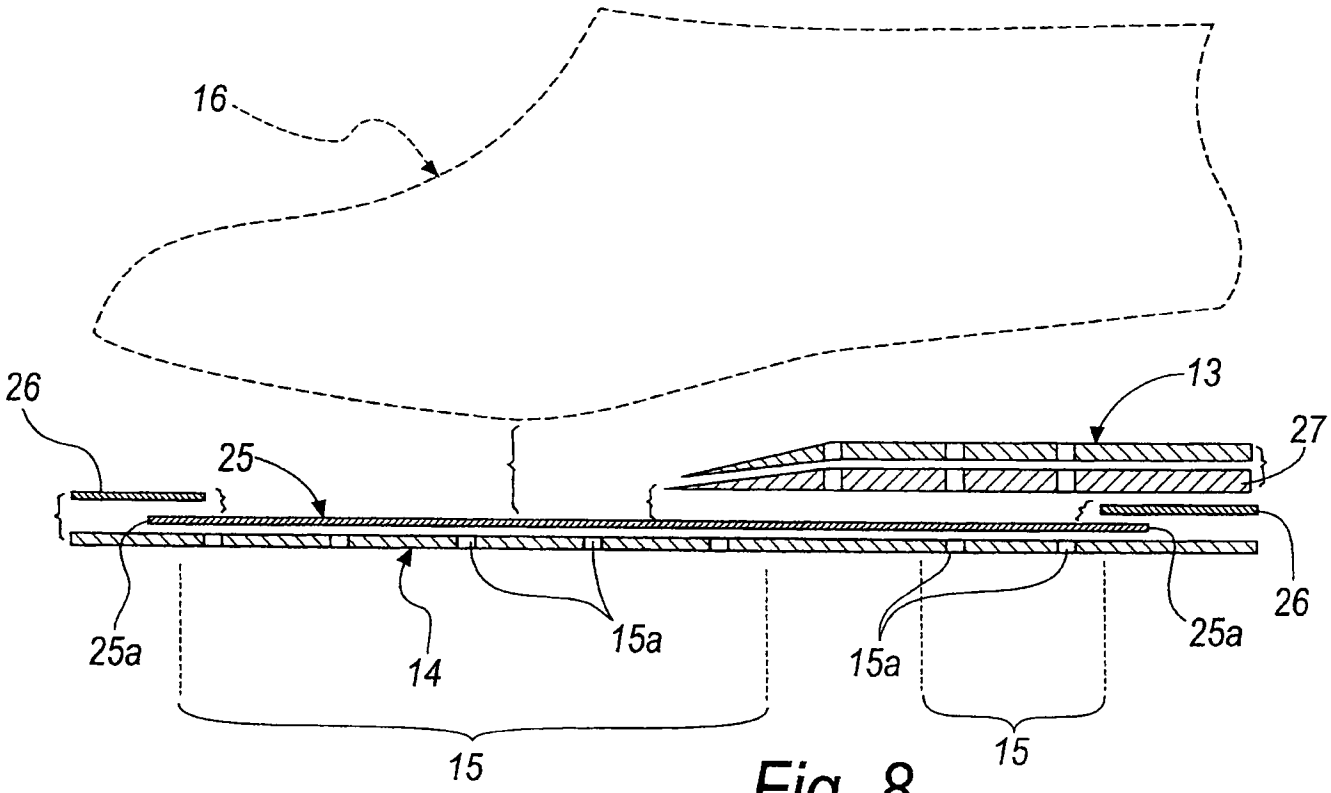
FIG. 8 is an exploded sectional view of a diagram of a portion of a waterproof and vapor-permeable shoe according to the invention.

With reference to FIG. 8, advantageously there is a sealing film 26 made of thermoplastic polymeric material, which seals perimetrically the plantar insert 25 to the first gasket 14, at least so as to cover impermeably its vapor-permeable or perforated portion 15.

The first gasket 14 is conveniently joined by a gluing to the assembly insole 13, which affects only the plantar arch and the heel and is conveniently made of a cellulose-like material, such as Texon, which is conveniently reinforced in a downward region with a shank 27 that is vapor-permeable or perforated at least at the vapor permeation region 12 of the sole 11.

Advantageously, the shank 27 is made of leather, plastic material or metal, for greater support and torsion resistance of the shoe.

The sealing film 26 is preferably made of thermoplastic hot-melt adhesive of the type already cited, Bemis 3218, or the like.

In this manner, the use of the sealing film 26 to seal perimetrically from above the plantar insert 25 to the first gasket 14 allows to simplify and speed up the production process of the waterproof and vapor-permeable shoe 10 with respect to the use of a seal by perimetric gluing from below, for example with a polyurethane adhesive of the currently known and commonly used type.

In the case of sealing of the plantar insert 25 to the first gasket 14 from below the plantar insert 25, first of all the plantar insert 25 and the first gasket 14 are treated with the polyurethane adhesive and then one waits for the correct drying period, which varies from 10 to 20 minutes, before reactivating the polyurethane adhesive and pressing the elements to promote their adhesion.

In the case of sealing of the plantar insert 25 to the first gasket 14 by means of the sealing film 26 arranged above the plantar insert 25, one instead proceeds as follows.

The sealing film 26 is glued, by means of fresh polyurethane adhesive, so as to straddle the perimeter 25*a* of the plantar insert 25, onto said insert and onto the first gasket 14.

The assembly is then hot-pressed in order to promote its adhesion, thus saving the time for the drying of the polyurethane adhesive.

Conveniently, a filler and protective element of the plantar insert 25, not shown in the accompanying figures, is between the insert and the sole 111 at the holes or openings 112*a*, which are free and pass through its thickness and which said sole has in the vapor permeation region 112.

Said filler and protective element is advantageously made of a material that is resistant to hydrolysis, water repellent and vapor-permeable or perforated, made for example of felt, nonwoven fabric or the like, and protects the plantar insert 25 against impacts or foreign objects that might penetrate through the holes or openings 112*a*.

The use of said filler and protective element further leads to the advantage of filling the difference in level caused by the lasting margins.

Figure 9:
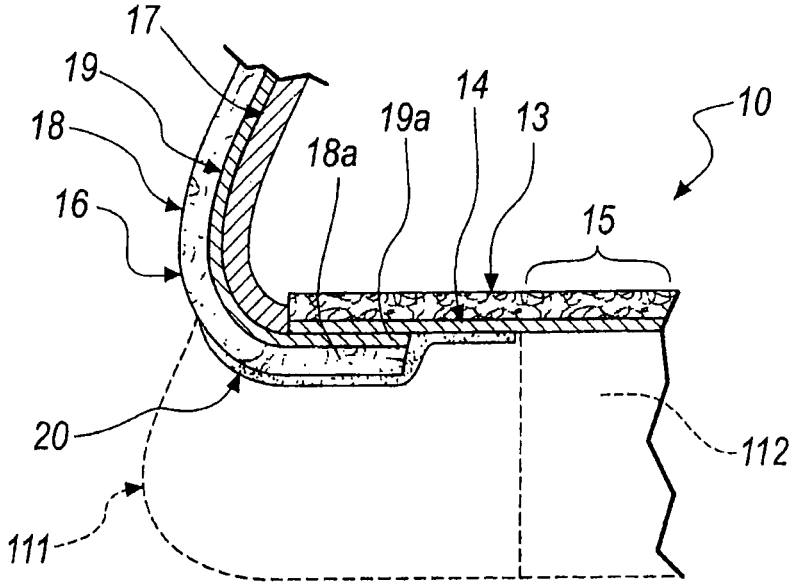

With reference to FIG. 9, in a seventh embodiment of a waterproof and vapor-permeable shoe 10, according to the invention, the first gasket 14 is preferably, in at least one of its layers, made of waterproof and vapor-permeable polymeric material.

The first gasket 14, and in particular at least said layer thereof, is sealed perimetrically to a sole 111 by means of the second gasket 20, so as to seal against water its vapor permeation region 112, which has at least one hole or opening 112*a* which are free and pass through its thickness, for the evacuation of the water vapor that originates from the foot insertion region A.

In particular, the second gasket 20 conveniently surmounts and straddles the lower edge 18*a* and the first gasket 14, sealing them against water to each other and to the sole 111.

The second gasket 20 advantageously is a film made of thermoplastic hot-melt adhesive, made of polyurethane, polyester, polyamide or polyolefins, which can activated by means of heat and pressure.

Said film, heated and subjected to pressing, softens and penetrates the permeable substrates to be sealed, onto which it is pressed.

By cooling, it then establishes a connection by adhesive bonding of a mechanical and chemical type with said substrates and reacquires its original strength.

A film that is particularly suitable for providing the second gasket 20 is proposed commercially by the company Bemis Associates Inc with product code 3218, or by the company Collano AG, XIRO Adhesive Films with product code XAF 36.004 (Puro).

Advantageously, said waterproof and vapor-permeable polymeric material for providing at least one layer of the first gasket 14 is expanded polytetrafluoroethylene, also known as e-PTFE, or polyurethane, also known as PU, or similar materials, and is optionally associated on its faces with one or two meshes.

The vapor permeation region 112 preferably extends substantially along the entire longitudinal direction of the sole 111 and the first gasket 14 covers such region so as to form a waterproof and vapor-permeable seal.

Conveniently, a filler and protective element of the first gasket 14, not shown in the accompanying figures, is between said gasket and the sole 111 at the holes or openings 112*a*, which are free and pass through its thickness and which said sole has in the vapor permeation region 112.

Said filler and protective element is made of a material that is resistant to hydrolysis, water repellent and vapor-permeable or perforated, and protects the first gasket 14 against impacts or foreign objects that might penetrate through the holes 112*a*.

The use of said filler and protective element further provides the advantage of filling the difference in level caused by the lasting margins.

Figure 10:
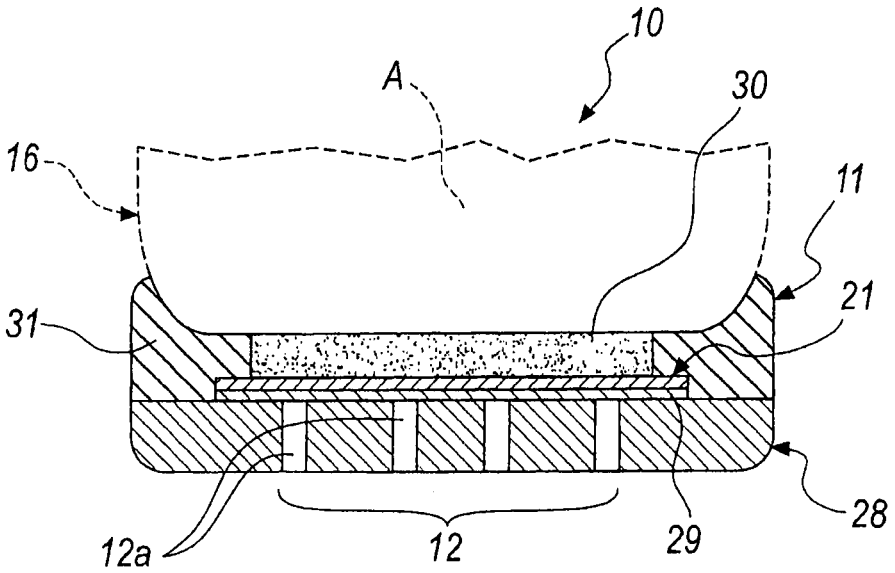
FIGS. 10, 11 and 12 are sectional views of soles of waterproof and vapor-permeable shoes provided according to the invention in several embodiments.
Figure 11:
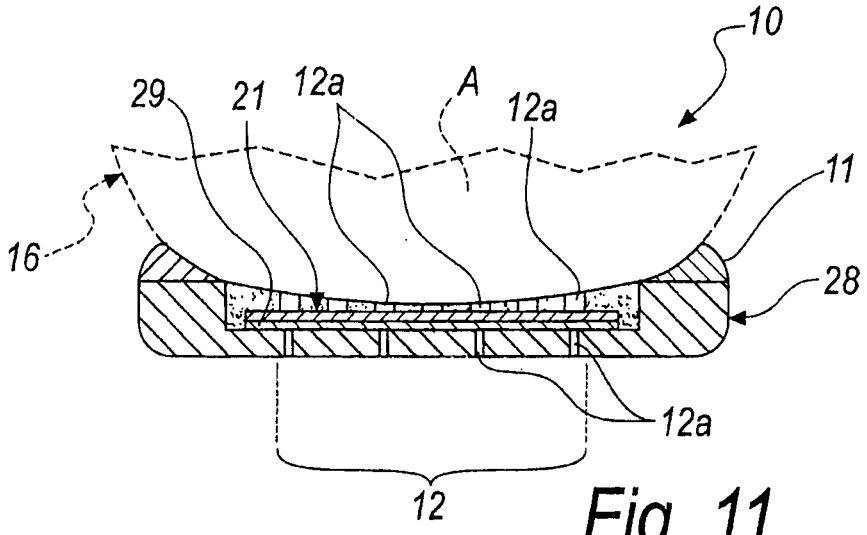
Figure 12:
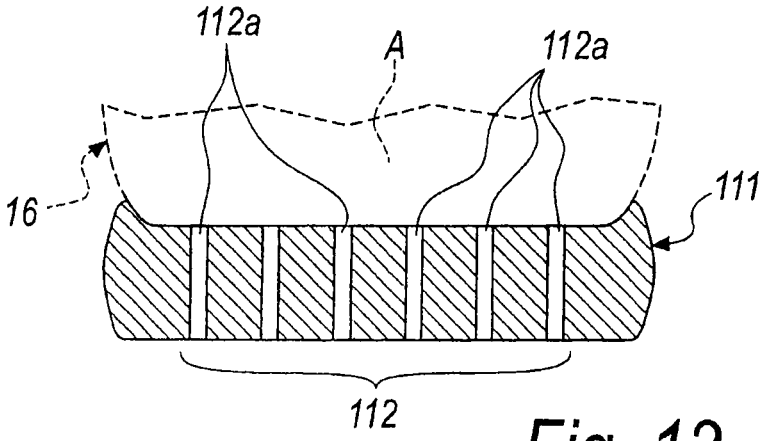

In particular, FIGS. 10 and 11 illustrate by way of non-limiting example alternative embodiments of a sole 11 of a waterproof and vapor-permeable shoe 10 according to the invention.

In a first one of said embodiments, the sole 11 comprises

- a lower tread body 28, which has, at the vapor permeation region 12, through holes or openings 12*a*, which are covered by a protective layer 29 that is advantageously resistant to hydrolysis, water repellent, vapor-permeable or perforated,
- the waterproof and vapor-permeable insert 21, which is superimposed on the protective layer 29, to be protected thereby against impacts and penetrations through the holes or openings 12*a*,
- a vapor-permeable or perforated filler 30, made for example of felt or similar material, which is superimposed on the waterproof and vapor-permeable insert 21,
- a midsole 31, which surrounds the filler 30 and is connected to the lower body 28 and sealed to the waterproof and vapor-permeable insert 21.

The method for providing the sole 11 in said first embodiment consists in

- molding the lower body 28,
- arranging the lower body 28 in the mold of the midsole 31,
- superimposing the protective layer 29 on the lower body 28, at the vapor permeation region 12,
- superimposing the waterproof and vapor-permeable insert 21 on the protective layer 29,
- superimposing the filler element 30 on the waterproof and vapor-permeable insert 21,
- injecting the midsole 31 so as to form an annular element that surrounds the filler element 30 so as to provide a perimetric seal of the waterproof and vapor-permeable insert 21.

In practice it has been found that the invention achieves the intended aim and objects, providing a waterproof and vapor-permeable shoe that allows to prevent the infiltration of water between the assembly insole and the sole, being structurally simpler than currently known waterproof and vapor-permeable shoes.

Moreover, a waterproof and vapor-permeable shoe provided according to the invention, predominantly by means of the method known as "AGO lasting", has an effective and durable seal of the waterproof and vapor-permeable upper shoe assembly to the sole.

In a waterproof and vapor-permeable shoe according to the invention it is also possible to avoid effectively the stagnation of water between the assembly insole and the sole and its wicking within the shoe by the vapor-permeable or perforated portion of the first gasket, thanks to the second gasket that extends the waterproof sealing area of the upper shoe assembly to the sole, also to the upper and thus stops infiltrations of any water absorbed by the material of which the upper is made.

Moreover, a waterproof and vapor-permeable shoe according to the invention is effectively and durably impermeable, and at the same time is effectively vapor-permeable through its upper and through its sole, having a waterproof sealing structure that is simple and easy to provide.

For the sealing of a rubber sole, which is impermeable to the water in the liquid state and permeable to water vapor, obtained by using a vapor-permeable and waterproof membrane that is sealed to the body of the sole so as to cover through openings thereof, to the upper shoe assembly of the shoe, composed of the upper shoe assembly joined to an assembly insole, as described for example with reference to a waterproof and perforated inshoe in patent application WO 2005/070658, currently a perimetric band of said waterproof and perforated inshoe that is internal to the lasting margins that are folded thereon and glued is in fact currently generally used for this purpose.

As is currently known, said perimetric band, in order to achieve effective sealing, has specific minimum extension limits.

Therefore, currently the vapor permeation region of the sole is necessarily limited to the area inside said perimetric band.

In a waterproof and vapor-permeable shoe, according to the invention, the second gasket, which is made of sealing material, instead forms an equivalent perimetric band for sealing the sole to the upper shoe assembly, which to a good extent coincides with the outer part of the lasting margins.

In this manner, the vapor permeation region of the sole is, in a shoe according to the invention, larger than in a shoe with a perforated waterproof and vapor-permeable sole, of the currently known type, said vapor permeation region being able to reach at least up to the lasting margins.

This allows, therefore, to provide a shoe that has a greater vapor permeation capacity through the sole with respect to currently known shoes.

Moreover, in a waterproof and vapor-permeable shoe according to the invention, the lower edge of the upper is sealed between the second gasket and the first gasket or between the second gasket and the auxiliary gasket, depending on the embodiment.

In this manner, infiltration of water wicked by the upper toward the region below the assembly insole is prevented and likewise so is the wicking of water toward the upper through the holes or openings of the sole.

In a waterproof and vapor-permeable shoe according to the invention, moreover, the second gasket, by adhering to the lasting margins that are folded onto the assembly insole, covers any corrugations thereof formed by the assembly creases, therefore making it easier to provide the waterproof connection of the sole to the upper shoe assembly.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in European Patent Application No. 09425137.8 from which this application claims priority are incorporated herein by reference.

The invention claimed is:

1. A waterproof and vapor-permeable shoe, comprising:

a sole, provided with a vapor permeation region;

an assembly insole, which is covered, toward the sole, by at least one first gasket made of waterproof material, which has at least one vapor-permeable or perforated portion above said vapor permeation region, which, once assembled, covers an upper shoe assembly, which comprises at least one vapor-permeable lining, a vapor-permeable upper, and a waterproof and vapor-permeable upper membrane that is between them, said upper shoe assembly being associated with said assembly insole at least predominantly by AGO lasting, the upper shoe assembly including an upper lasting margin that is at least predominantly interposed and connected between the insole and the sole; and at least one second gasket made of waterproof material, the at least one second gasket adheres to said first gasket so as to form a waterproof seal and is glued to a lower edge of said upper lasting margin, wherein said second gasket forms a waterproof sealing region of said upper shoe assembly and said first gasket to said sole, leaving free for vapor permeation at least said vapor-permeable or perforated portion, wherein a lower rim of said upper membrane and the lower edge of said upper lasting margin are joined, folded and glued hermetically, according to AGO lasting, below a perimetric edge of said first gasket, and wherein he second gasket surmounts and straddles the lower edge of the upper lasting margin and said first gasket so that the second gasket is in direct contact with each of the upper lasting margin and the first gasket.

2. The waterproof and vapor-permeable shoe according to claim 1, wherein said second gasket surmounts and straddles said lower edge and said first gasket to thereby seal them impermeably to each other and to said sole.

3. The waterproof and vapor-permeable shoe according to claim 2, wherein said lower edge is provided with a sealing element that is joined to the lower rim of said upper membrane, said lower rim and said sealing element being folded and glued so as to form a seal, according to AGO lasting, below the perimetric edge of said first gasket, said second gasket surmounting and straddling said sealing element and said first gasket, sealing them impermeably to each other and to said sole.

4. The waterproof and vapor-permeable shoe according to claim 3, wherein said sealing element is made of waterproof and heat-activatable polymeric material, which adheres intimately so as provide a seal to said lower rim and to said second gasket, sealing them to each other.

5. The waterproof and vapor-permeable shoe according to claim 3, wherein said sealing element is permeable to sealing material, the material that constitutes said second gasket being permeated through said sealing element so as to grip, forming a waterproof seal, said lower rim, sealing it impermeably to said first gasket.

6. The waterproof and vapor-permeable shoe according to claim 1, wherein the lower flap of said lining and the lower rim of said upper membrane are joined, said lower flap being skived so as to expose said lower rim, said lower rim being exposed through said lower flap, skived, folded and glued hermetically, according to AGO lasting, below the perimetric edge of said first gasket, said second gasket surmounting and straddling said lower edge and said first gasket, sealing them impermeably to each other and to said sole.

7. The waterproof and vapor-permeable shoe according to claim 1, wherein said first gasket is made of waterproof polymeric material, said sole having one or more broad openings or a plurality of holes that face said vapor-permeable or perforated portion and are covered so as to form a seal by a waterproof and vapor-permeable insert, in order to allow the evacuation of vapor from a foot insertion region, at the same time preventing the rise of liquid toward it.

8. The waterproof and vapor-permeable shoe according to claim 1, further comprising a waterproof and vapor-permeable plantar insert that is between said assembly insole and said first gasket at least at said vapor-permeable or perforated portion, said plantar insert being sealed, along its perimeter, an as to cover at least said vapor-permeable or perforated portion, said vapor-permeable or perforated portion being sealed perimetrically by said second gasket to said sole so as to cover said vapor permeation region.

9. The waterproof and vapor-permeable shoe according to claim 8, further comprising a sealing film made of thermoplastic polymeric material that seals perimetrically said plantar insert to said first gasket at least so as to cover impermeably said vapor-permeable or perforated portion thereof.

10. The waterproof and vapor-permeable shoe according to claim 1, wherein said sole has one or more broad openings or a plurality of free holes that pass through its thickness for the evacuation of the water vapor that arrives from a foot insertion region.

11. The waterproof and vapor-permeable shoe according to claim 1, wherein said sole has one or more broad openings or a plurality of holes that face said vapor-permeable or perforated portion and are covered so as to form a seal by a waterproof and vapor-permeable insert in order to allow the evacuation of vapor from a foot insertion region, at the same time preventing the rise of liquid toward it.

12. The waterproof and vapor-permeable shoe according to claim 1, wherein said first gasket is, at least in one of its layers, made of waterproof and vapor-permeable polymeric material and is sealed perimetrically to said sole, by means of said second gasket, so as to provide a waterproof seal of said vapor permeation region.

13. The waterproof and vapor-permeable shoe according to claim 12, wherein said sole has one or more broad openings or a plurality of free holes that pass through its thickness, for the evacuation of the water vapor that arrives from the foot insertion region.

14. The waterproof and vapor-permeable shoe according to claim 12, wherein said sole has one or more broad openings or a plurality of holes that face said vapor-permeable or perforated portion and are covered so as to form a seal by a waterproof and vapor-permeable insert in order to allow the evacuation of vapor from a foot insertion region, at the same time preventing the rise of liquid toward said region.

15. The waterproof and vapor-permeable shoe according to claim 8, wherein the plantar insert comprises at least one membrane made of expanded polytetrafluoroethylene or polyurethane, and wherein the plantar insert includes on its faces one or two meshes.

* * * * *